United States Patent [19]

Hoover

[11] Patent Number: 4,964,391

[45] Date of Patent: Oct. 23, 1990

[54] CHECK VALVE FOR ENGINE FUEL DELIVERY SYSTEMS

[75] Inventor: Thomas M. Hoover, Reese, Mich.

[73] Assignee: Walbro Corporation, Cass City, Mich.

[21] Appl. No.: 358,860

[22] Filed: May 30, 1989

[51] Int. Cl.[5] ..... F02M 39/00

[52] U.S. Cl. ..... 123/510; 123/467; 137/542

[58] Field of Search ..... 123/467, 510, 506, 511, 123/512; 137/542, 541, 540, 514.5, 543

[56] References Cited

U.S. PATENT DOCUMENTS

| | | | |
|---|---|---|---|
| 620,936 | 3/1899 | Kunzer | 137/542 |
| 2,524,951 | 10/1950 | Ashton | 137/542 |
| 2,593,522 | 4/1952 | Barnes | 137/542 |
| 2,845,945 | 8/1958 | Mancusi | 137/542 |
| 2,909,192 | 10/1959 | Dobrick | 137/542 |
| 2,964,029 | 12/1960 | Tirloni | 123/510 |
| 2,973,008 | 2/1961 | Klose | 137/543 |
| 3,742,926 | 7/1973 | Kemp | 123/506 |
| 4,336,824 | 6/1982 | Steneman | 137/542 |
| 4,665,881 | 5/1987 | Wade | 123/467 |
| 4,757,795 | 7/1988 | Kelly | 123/506 |

*Primary Examiner*—Carl Stuart Miller

*Attorney, Agent, or Firm*—Barnes, Kisselle, Raisch, Choate, Whittenmore & Hulbert

[57] ABSTRACT

In a fuel delivery system that includes a pump for supplying fuel under pressure from a supply to an internal combustion engine, a check valve is positioned between the pump and the engine for preventing back-flow of fuel from the engine to the pump. The valve has a flow passage with a central axis and a valve seat orientated away from the pump. A valve element is positioned within the passage for axial motion against a coil spring as a function of fuel pressure from the pump. The coil spring is captured in compression between the valve element and a guide positioned downstream of the valve element within the flow passage. A stem that extends axially from the valve element is slidably disposed in a central bore in the guide. An orifice couples the bore to the fluid flow passage. The guide and valve stem thereby not only restrain lateral motion of the valve element within the passage, but also form a piston/cylinder construction that cooperates with the orifice to dampen axial motion of the valve element. Thus, axial and lateral motions of the valve element are stabilized, greatly reducing the vibrational signature of the pump and check valve system, and reducing pressure pulses delivered from the pump to the engine.

8 Claims, 1 Drawing Sheet

CHECK VALVE FOR ENGINE FUEL DELIVERY SYSTEMS

The present invention is directed to fuel delivery systems for internal combustion engines and the like, and more particularly to an improved check valve for disposition between the fuel pump and the engine.

BACKGROUND AND OBJECTS OF THE INVENTION

Fuel delivery systems of the subject character typically include a pump for delivering fuel under pressure from a supply to a fuel consumer, such as an internal combustion engine. A check valve is connected between the pump and the engine for preventing back-flow of fuel from the engine to the pump when the pump is turned off. Fuel pressure is thereby maintained at the engine, resulting in reduced start-up time. Typically, the check valve includes a valve element biased by a spring against a seat within a fuel passage. U.S. Pat. No. 4,697,995 discloses a check valve of the described construction carried by the housing of a fuel pump, and thus constructed as a unitary assembly with the pump. The valve element is "free floating" in the passage, and the spring is tapered toward the valve element to help stabilize the element against lateral motion.

Although fuel delivery systems of the described character, as illustrated in the noted U.S. Patent, have enjoyed substantial commercial acceptance and success, improvements remain desirable. For example, positive displacement fuel pumps conventionally employed in automotive engine fuel delivery systems typically are of construction that deliver intermittent fuel pressure pulses over and above a constant or average fuel pressure. These pressure pulsations affect engine operation and can present a noise problem, and reduction or elimination thereof is desirable. Further, there is a marked tendency for the valve element to oscillate laterally around an average position, thus exacerbating the problem of pressure pulses in the pump output.

A general object of the present invention, therefore, is to provide a check valve that finds particular utility in fuel delivery systems of the subject character, but also enjoys wide application in other flow control environments of similar nature, and that helps reduce or eliminate pressure pulses in the fuel delivery line. A more specific object of the invention is to provide a check valve of the described character in which lateral motion of the the valve element is restrained, while axial motion is free but damped.

SUMMARY OF THE INVENTION

A check valve in accordance with a presently preferred embodiment of the invention comprises a valve element, a fluid flow passage surrounding the valve element and having an internal valve seat opposed to the valve element, and a spring positioned within the passage for urging the valve element against the seat. A guide is positioned in the passage and has a central bore coaxial with the passage. A stem extends from the valve element slidably into the bore for guiding motion of the valve element axially of the passage while restraining motion of the valve element laterally of the passage. Preferably, the bore is coupled to the passage through an orifice coaxial with the bore and passage. The orifice is sized to dampen axial motion of the valve element and stem over a preselected frequency range, thereby further reducing and dampening pulsations of the valve element and in the fluid line.

In a fuel delivery system that includes a pump for supplying fuel under pressure from a supply to an internal combustion engine in a preferred implementation of the present invention, the check valve is positioned between the pump and the engine for preventing back-flow of fuel from the engine to the pump. The valve has a flow passage with a central axis and a valve seat orientated away from the pump. The valve element is positioned within the passage for axial motion against a coil spring as a function of fuel pressure from the pump. The coil spring is captured in compression between the valve element and a guide positioned downstream of the valve element within the flow passage. A stem that extends axially from the valve element is slidably disposed in a central bore in the guide. An orifice couples the bore to the fluid flow passage. The guide and valve stem thereby not only restrain lateral motion of the valve element within the passage, but also form a piston/cylinder construction that cooperates with the orifice to dampen axial motion of the valve element. Thus, axial and lateral motions of the valve element are stabilized in the preferred implementation of the invention, greatly reducing pressure pulses delivered from the pump to the engine.

BRIEF DESCRIPTION OF THE DRAWING

The invention, together with additional objects, features and advantages thereof, will be best understood from the following description, the appended claims and the accompanying drawing in which:

DETAILED DESCRIPTION OF PREFERRED EMBODIMENT

Figure 1:
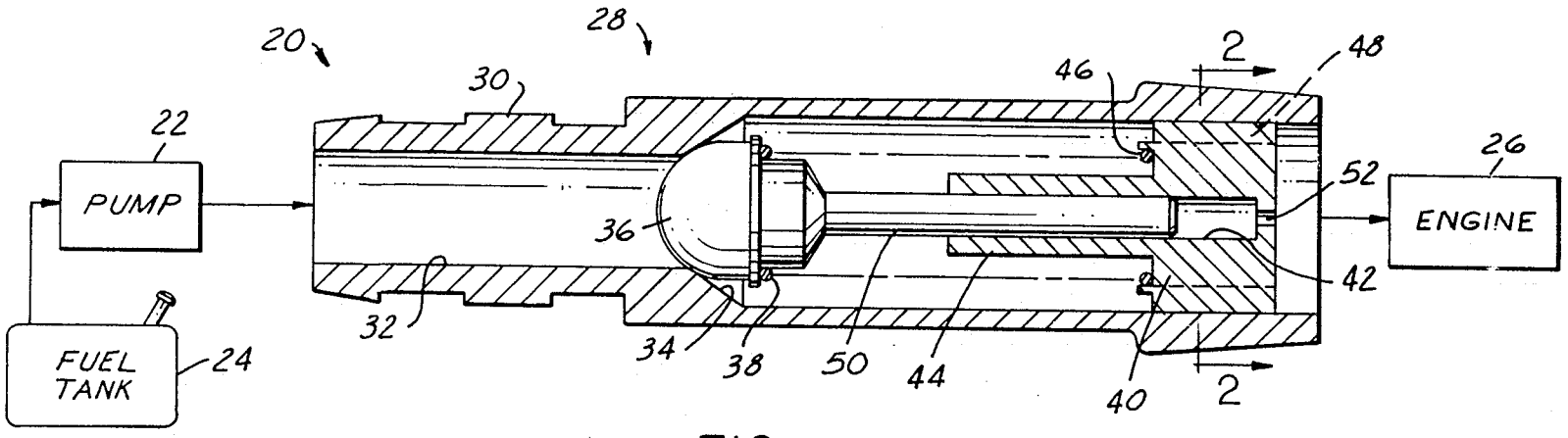
FIG. 1 is a partially schematic and partially sectional view in side elevation of a fuel delivery system that includes a check valve in accordance with one presently preferred embodiment of the invention.

FIG. 1 illustrates a fuel delivery system 20 in accordance with one presently preferred embodiment of the invention as comprising a fuel pump 22 for delivering fuel under pressure from a supply or tank 24 to a fuel consumer 26, such as an internal combustion engine. A check valve 28 is connected in the fuel line between pump 22 and engine 26 for permitting free flow of fuel from the pump to the engine, but preventing back-flow of fuel from the engine to the pump when the pump is shut off. In general, valve 28 includes a sleeve or fitting 30 having an internal passage 32 formed with a valve seat 34. A valve element 36 is positioned within passage 32 downstream of seat 34 with respect to the direction of fuel flow from pump 22 to engine 26. A coil spring 38 is captured in compression within passage 32 for urging valve element 36 against valve seat 34. Pressure of fuel from pump 22 against valve element 36 urges the valve element to the right in FIG. 1 against the force of spring 38, and thereby lifts the valve element from the valve seat to permit passage of fuel therepast. To the extent thus far described, system 20 of FIG. 1 is generally similar to that disclosed in above-noted U.S. Pat. No. 4,697,995, in which fitting 30 is formed integrally with the housing of pump 22.

Figure 2:
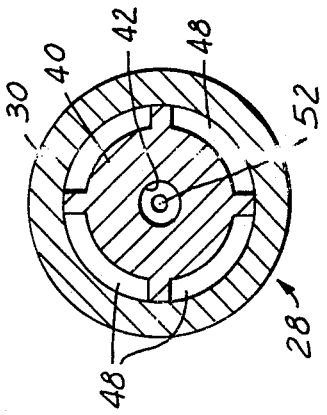
FIG. 2 is a sectional view taken substantially along the line 2—2 in FIG. 1.

In accordance with the present invention, a guide 40 is press fitted or otherwise positioned within passage 32 downstream of valve element 36, which is to say on the side of valve element 36 opposed to valve seat 34. Guide 40 has a cylindrical bore 42 (FIGS. 1 and 2) coaxial with passage 32. A neck 44 projects from guide 40 integrally therewith into the coils of spring 38 and partially defining bore 42. Spring 38 is captured in compression between the back face of the hemispherical head of valve element 36 and the opposing surface of guide 40, being restrained from lateral motion with respect thereto by neck 44 and an annular lip 46 on guide 40 embracing spring 38. Arcuate slots 48 extend through guide 40 for permitting passage of fuel therethrough.

A stem 50 affixed to element 36 extends coaxially therefrom and is slidably disposed within bore 42. Guide 40 thereby restrains lateral motion of valve element 36 while guiding axial motion thereof. The base of stem 50 at element 36 is enlarged and embraced by the coils of spring 38 to stabilize the spring. An orifice 52 couples bore 42 to passage 32 downstream of bore 42 and coaxially with passage 32. Stem 50 and bore 42 thus form a fluid piston/cylinder arrangement that cooperates with orifice 52 for damping axial motion of valve element 36. Orifice 52 is sized in cooperation with the bore/stem diameters and fluid flow requirements to dampen motion of the valve element over a preselected frequency range. Damping axial valve motion thus allows a broader tuning range through which the valve will dampen pulsating flows, and also cooperates with restraint of lateral motion to reduce the noise signature of the valve itself.

I claim:

1. A fuel delivery system for an internal combustion engine or the like that includes a fuel supply, a fuel pump for delivering fuel under pressure from the supply to the engine, and a check valve between the pump and the engine for preventing back-flow of fuel from the engine to the pump, said check valve comprising a valve element, means defining a flow passage surrounding said element including a valve seat opposed to said element, spring means for urging said element against said seat, motion of said valve element off of said seat against said spring means being a function of fuel pressure from said pump, guide means positioned in said passage on a side of said valve element remote from said seat and having a central bore coaxial with said passage, means extending from said valve element slidably disposed in said bore for guiding motion of said valve element axially of said passage and restraining motion of said valve element laterally of said passage, and a fluid orifice connecting said bore with said passage coaxially with said bore and passage at an end of said bore remote from said valve element, said bore, said means slidably disposed in said bore and said fluid orifice cooperating to form a fluid piston/cylinder construction for damping axial motion of said valve element in said passage, said orifice being of a diameter to dampen motion of said valve element over a preselected frequency range.

2. The system set forth in claim 1 wherein said guide means is spaced from said valve element axially of said passage, and wherein said spring means comprises a coil spring captured in compression between said guide means and said valve element.

3. The system set forth in claim 2 wherein said guide means includes a neck extending into said coil spring and partially defining said bore.

4. In a fluid delivery system that includes a pump for supplying fluid under pressure from a supply to a consumer, a check valve positioned between the pump and the consumer that includes a flow passage having a central axis and a valve seat oriented axially away from the pump, a valve element positioned in said passage for axial motion as a function of fluid pressure from the pump, spring means urging said element against said seat, guide means positioned in said passage on a side of said valve element opposite said seat, said guide means having a central bore coaxial with said passage, means extending from said valve element slidably disposed in said bore, and an orifice interconnecting said bore with said passage coaxially with said bore and said passage at an end of said bore remote from said element, said orifice being of a diameter to dampen motion of said valve element over a preselected frequency range.

5. A fluid check valve that comprises a valve element, a fluid passage surrounding said element and having an internal valve seat opposed to said element, spring means positioned within said passage for urging said element against said seat, guide means positioned in said passage and having a central bore coaxial with said passage, means extending from said valve element slidably disposed in said bore for guiding motion of said valve element axially of said passage and restraining motion of said valve element laterally of said passage, and a fluid orifice connecting said bore with said passage on a side of said bore remote from said valve element, said bore, said means slidably disposed in said bore and said fluid orifice being coaxial with each other and cooperating to form a fluid piston/cylinder construction for damping axial motion of said valve element in said passage.

6. The valve set forth in claim 5 wherein said guide means is positioned on a side of said valve element remote from said seat.

7. The valve set forth in claim 6 wherein said spring means comprises a coil spring captured in compression between said guide means and said valve element.

8. A fuel delivery system for an internal combustion engine or the like that includes a fuel supply, a fuel pump for delivering fuel under pressure from the supply to the engine, and a check valve between the pump and the engine for preventing back-flow of fuel from the engine to the pump, said check valve being located in a cylindrical chamber having a pump end and an engine end, a valve seat at the pump end of said chamber and a valve guide at the engine end of said chamber, said valve guide having external axial passages adjacent the wall of said chamber and open at one end to said valve seat and at the other end to said engine end, said valve guide having a central bore with a restricted fluid orifice at the engine end, a guide stem projecting axially from said valve guide and extending toward said valve seat in said chamber having a bore coaxial with said central bore in said valve guide, a valve element in said chamber having one end to cooperate with said valve seat and an ensmalled guide element at the other end projecting from said valve element slidably received in said bores in a piston-cylinder relationship for damping axial motion of said valve element, spring means biasing said valve element toward said seat away from said guide means, said orifice being of a diameter to dampen motion of said guide element and valve element over a preselected frequency range.

* * * * *